US006572685B2

(12) United States Patent
Dunshee

(10) Patent No.: US 6,572,685 B2
(45) Date of Patent: Jun. 3, 2003

(54) AIR FILTER ASSEMBLY HAVING AN ELECTROSTATICALLY CHARGED FILTER MATERIAL WITH VARYING POROSITY

(75) Inventor: Kevin Bryant Dunshee, Camillus, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/939,994

(22) Filed: Aug. 27, 2001

(65) Prior Publication Data

US 2003/0037676 A1 Feb. 27, 2003

(51) Int. Cl.[7] ..... B03C 3/155

(52) U.S. Cl. ..... 96/59; 55/487; 96/66; 96/68

(58) Field of Search ..... 55/487; 96/59, 96/66, 67, 70, 68

(56) References Cited

U.S. PATENT DOCUMENTS

| | | | | | |
|---|---|---|---|---|---|
| 1,560,790 | A | * | 11/1925 | Jordahl | 55/487 |
| 2,822,059 | A | * | 2/1958 | Lunn et al. | 55/487 |
| 4,354,858 | A | * | 10/1982 | Kumar et al. | 96/66 X |
| 4,597,781 | A | * | 7/1986 | Spector | 55/487 X |
| 4,886,527 | A | * | 12/1989 | Fottinger et al. | 55/487 X |
| 4,976,858 | A | * | 12/1990 | Kadoya | 55/487 X |
| 4,983,193 | A | * | 1/1991 | Tani et al. | 55/487 |
| 5,037,455 | A | * | 8/1991 | Scheineson et al. | 55/487 X |
| 5,123,936 | A | * | 6/1992 | Stone et al. | 55/487 X |
| 5,336,299 | A | * | 8/1994 | Savell | 55/487 X |
| 5,549,735 | A | | 8/1996 | Coppom | 96/63 |
| 5,593,476 | A | | 1/1997 | Coppom | 96/63 X |
| 5,667,544 | A | * | 9/1997 | Haas et al. | 55/487 X |
| 5,871,567 | A | | 2/1999 | Covington et al. | 96/58 |
| 5,989,320 | A | * | 11/1999 | Rutkowski | 96/66 X |
| 6,235,089 | B1 | * | 5/2001 | Erdmannsdoerfer | 55/487 X |

OTHER PUBLICATIONS

ElectroFiltration Technologies, Inc. brochure, Feb. 23, 1999.

* cited by examiner

*Primary Examiner*—Richard L. Chiesa
(74) *Attorney, Agent, or Firm*—Carlson, Gaskey & Olds

(57) ABSTRACT

An air filter assembly includes a filter media that is electrostatically charged. The filter media has a first porosity at the inlet side and a second porosity at the outlet side. An electrostatic charge preferably is maintained across the entire filter media to enhance the particle gathering qualities of the media. In one example, multiple layers of filter materials having different porosities are used. In another example, a single filter material having a progressively decreasing porosity is used. One example includes a conductive filter layer that serves as one of the electrodes for the electrostatic field generating portion of the assembly.

16 Claims, 1 Drawing Sheet

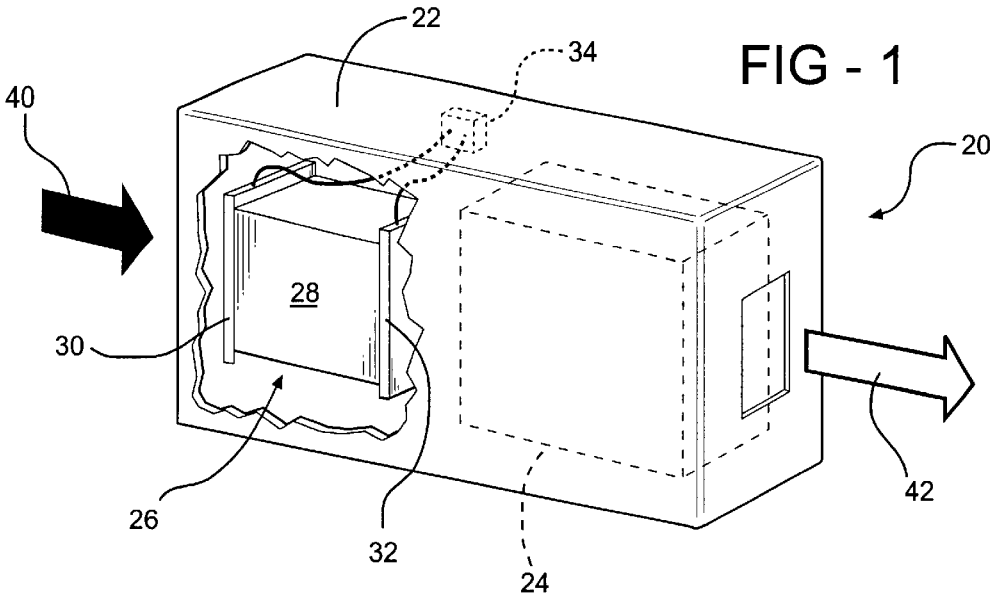
FIG - 1
FIG - 2
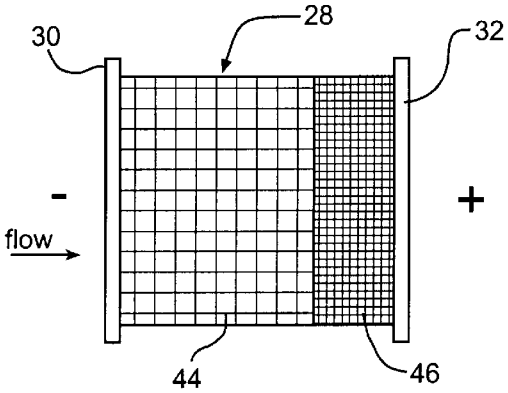
FIG - 3
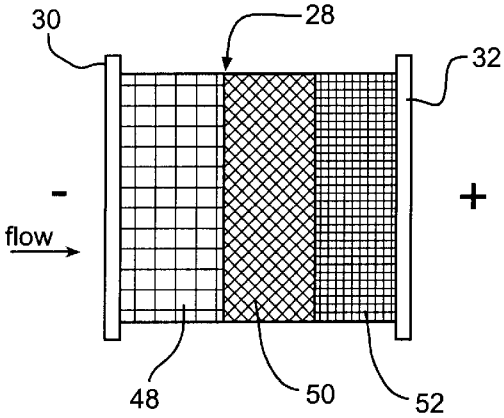
FIG - 4
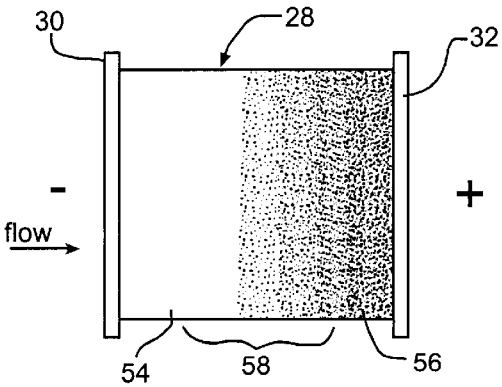
FIG - 5
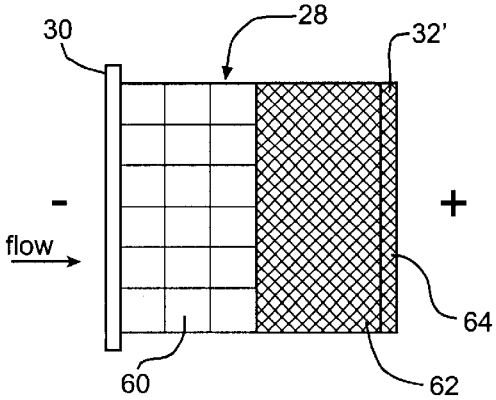

AIR FILTER ASSEMBLY HAVING AN ELECTROSTATICALLY CHARGED FILTER MATERIAL WITH VARYING POROSITY

BACKGROUND OF THE INVENTION

This invention generally relates to air filters. More particularly, this invention relates to air filters having varying porosity and an electrostatic charge applied to the filter material.

Air filters are used in a variety of applications. One particular use includes air handlers for heating and cooling systems within buildings. Air filters typically are placed within an air handler to filter out dust particles from the air that are present within the "return" flow from the building, which is conditioned (i.e. heated or cooled) before being returned to the building in a conventional manner.

There are several competing factors that influence the design of an air filter. Utilizing very low porosity filter material provides the ability to filter out particles from the air down to very minute sizes. Such material, however, often becomes relatively quickly congested or plugged by the particles collected. Because the porosity is so low, all particle sizes above that set for the particular material are gathered by the material and tend to clog the material. Accordingly, low porosity materials tend to have a limited life and cause pressure drop in the flow of air.

Other materials having higher porosity tend to last longer and not have the associated pressure drop, however, the ability to filter out minute particles is compromised.

One advancement in the filter art has been to apply an electrostatic field to a filter material to enhance the ability of the material to collect particles of different sizes. Such arrangements are shown in U.S. Pat. No. 5,549,735 and U.S. Pat. No. 5,593,476.

Another attempt at improving filter system performance has been to place a first filter in an air flow path followed by a second filter media with spacing between them. It has even been proposed to electrostatically charge the second filter media when the second filter media has a greater air permeability than the first. Such an arrangement is shown in U.S. Pat. No. 5,871,567.

While the above advances provide improvements, those skilled in the art are always striving to develop better systems. This invention provides an enhanced filter arrangement with greater efficiency.

SUMMARY OF THE INVENTION

In general terms, this invention is a filter assembly for filtering out particles from an air flow. An assembly designed according to this invention includes a field generator that generates an electrostatic field. A filter is electrostatically charged by the field generator. The filter has an inlet side and an outlet side. The inlet side has a first porosity while the outlet side has a second porosity that is lower than the first porosity.

In one example, the filter has multiple layers of filter media between the inlet and outlet sides. Each of the layers is preferably electrostatically charged.

In one example, one of the filter layers serves as an electrode for the field generating device. In this example, the final layer at the outlet side of the filter preferably is a carbon impregnated foam that is capable of being charged and cooperating with another electrode to provide an electrostatic field across the filter material.

In another example, the filter is made using a single material that has an increasing porosity across the material. In one such example, a foam having a first density at the inlet side has a second, greater density at the outlet side.

The various features and advantages of this invention will become apparent to those skilled in the art from the following detailed description of the currently preferred embodiments. The drawings that accompany the detailed description can be briefly described as follows.

BRIEF DESCRIPTION OF THE DRAWINGS

FIG. 1 schematically illustrates an air handling system designed according to this invention.

FIG. 2 schematically illustrates a first example filter assembly designed according to this invention.

FIG. 3 schematically illustrates a second example filter assembly designed according to this invention.

FIG. 4 schematically illustrates a third example filter assembly designed according to this invention.

FIG. 5 schematically illustrates a fourth example filter assembly designed according to this invention.

DETAILED DESCRIPTION OF THE PREFERRED EMBODIMENTS

An air handler assembly 20 includes a housing 22 that supports a plurality of components within the housing. In one example, the air handler assembler 20 is used for a heating and cooling system for controlling the temperature within a building.

An air mover unit 24, which in one example is a fan, draws air into the housing 22. The air preferably is filtered using a filter assembly 26 at some point between when the air enters the housing 22 and when it exits the housing.

The filter assembly 26 includes a filter media 28 that is electrostatically charged by a field generator. The illustrated example includes a field generator having a first electrode 30 associated with an inlet side of the filter material 28 and a second electrode 32 associated with the outlet side of the filter material 28. A field generator controller 34 preferably provides the electrical charge to the electrodes 30 and 32 to generate an electric field that results in electrostatically charging the filter material 28. Generating such fields and charging filter material in this manner is known. The first electrode 30 in one example is insulated and is negatively charged while the second electrode 32 is positively charged.

The filter assembly 26 filters air flow upstream at 40 into the air handler unit 20 prior to that air being appropriately processed within the air handler unit (i.e., heated or cooled, for example) before flowing downstream at 42.

The filter material 28 preferably has a first porosity at the inlet side and a second, lower porosity at the outlet side. Providing a larger porosity at the inlet side and a lower porosity at the outlet side provides for the ability to capture particles of varying sizes deeper within the filter material. The entire filter material 28 preferably is electrostatically charged.

In the example of FIG. 2, the filter material 28 includes a first layer 44 having a first porosity and a second layer 46 having a second, lower porosity. The layers 44 and 46 preferably are in contact with each other to maintain identical polarity across the entire filter material 28. The layers 44 and 46 may be the same material with different porosities or may be different materials, for example.

The example of FIG. 3 illustrates a filter material 28 having three layers 48, 50 and 52. In this example, the middle layer 50 has a porosity that is between the porosity of the layers 48 and 52. This example provides multiple layers of different porosities that decrease in the direction of flow through the filter material.

The example of FIG. 4 includes a single filter material 28 having a varying porosity across the material. A first area 54 has a first porosity and a second area at the outlet side 56 has a second, lower porosity. A central region 58 preferably has an increasingly dense material characteristic so that the porosity gradually increases through the filter material 28 in the direction from the inlet side toward the outlet side. In one example, the porosity progressively increases at a steady rate. One example such material includes a foam material having greater pore size at the inlet side with progressively decreasing pore size through the material toward the outlet side.

The example of FIG. 5 includes a first filter material layer 60 and a second filter material layer 62. A third layer 64 is provided at the outlet side of the filter material 28. In this example, the filter layer 64 carries an electrical charge and acts as the second electrode 32'. The layers 60 and 62 preferably are non-conductive filter media (as are the layers in all of the previously discussed examples). The layer 64, however, preferably is electrically conductive. The filter layer 64 provides a conductive grid to establish the electrostatic field across the filter material when operating in combination with the electrode 30. An example material useful for the conductive layer 64 includes a carbon impregnated foam.

The example of FIG. 5 has the additional advantage of odor controlling qualities. The electrically conductive, carbon impregnated foam serves an odor controlling function in addition to the particle collecting function of the filter assembly 26.

The preceding description is intended to provide examples rather than be limiting in nature. Variations and modifications to the disclosed examples may become apparent to those skilled in the art that do not necessarily depart from the essence of this invention. The scope of legal protection given to this invention can only be determined by studying the following claims.

I claim:

1. An air filter assembly, comprising:

an electrostatic field generator that provides an electrostatic field; and a filter having an inlet side and an outlet side with a first porosity at the inlet side and a second, lower porosity at the outlet side, the filter being electrostatically charged by the field generator, said electrostatic field generator comprising a first negatively charged electrode positioned adjacent the inlet side of the filter and a second positively charged electrode positioned adjacent the outlet side of the filter so that said electrostatic field generator polarizes said filter.

2. The assembly of claim 1, wherein the filter comprises a plurality of layers of filter material and wherein a first one of the layers has the first porosity and a second layer has the second porosity.

3. The assembly of claim 2, including at least one layer between the first and second layers having a third porosity that is greater than the second porosity and lesser than the first porosity.

4. The assembly of claim 1, wherein the filter includes a single filter material that has a decreasing porosity in a direction from the inlet side to the outlet side.

5. The assembly of claim 4, wherein the filter material comprises a foam having a lower density at the inlet side and a higher density at the outlet side.

6. The assembly of claim 5, wherein the density progressively increases between the inlet and outlet sides.

7. The assembly of claim 1, wherein the filter includes at least one layer of filter material that operates as the second electrode.

8. The assembly of claim 7, wherein the one layer of filter material comprises a carbon impregnated foam.

9. An air handler assembly, comprising:

a housing;

an air mover supported within the housing;

an electrostatic field generator supported within the housing that provides an electrostatic field; and a filter having an inlet side and an outlet side with a first porosity at the inlet side and a second, lower porosity at the outlet side, the filter being electrostatically charged by the electrostatic field generator, said electrostatic field generator comprising a first negatively charged electrode positioned adjacent the inlet side of the filter and a second positively charged electrode positioned adjacent the outlet side of the filter so that said electrostatic field generator polarizes said filter.

10. The assembly of claim 9, wherein the filter comprises a plurality of layers of filter material and wherein a first one of the layers has the first porosity and a second layer has the second porosity.

11. The assembly of claim 10, including at least one layer between the first and second layers having a third porosity that is greater than the second porosity and lesser than the first porosity.

12. The assembly of claim 9, wherein the filter includes a single filter material that has a decreasing porosity in a direction from the inlet side to the outlet side.

13. The assembly of claim 12, wherein the filter material comprises a foam having a lower density at the inlet side and a higher density at the outlet side.

14. The assembly of claim 13, wherein the density progressively increases between the inlet and outlet sides.

15. The assembly of claim 9, wherein the filter includes at least one layer of filter material that operates as the second electrode.

16. The assembly of claim 15, wherein the one layer of filter material comprises a carbon impregnated foam.

* * * * *